US005703577A

United States Patent [19]

Carter

[11] Patent Number: 5,703,577

[45] Date of Patent: Dec. 30, 1997

[54] SELF-ERECTING TRAFFIC CONTROL DEVICE

[76] Inventor: James R. Carter, 9001 Lakeridge Dr., Louisville, Ky. 40272

[21] Appl. No.: 595,268

[22] Filed: Feb. 1, 1996

[51] Int. Cl.[6] ..... G08G 1/095

[52] U.S. Cl. ..... 340/908; 340/907; 40/606; 40/608; 40/610; 40/612; 248/158; 248/160; 404/10

[58] Field of Search ..... 340/907, 908, 340/908.1; 40/612, 606, 608, 607, 610; 248/158, 160; 404/10, 11

[56] References Cited

U.S. PATENT DOCUMENTS

| | | | |
|---|---|---|---|
| 3,851,616 | 12/1974 | Brown | 116/63 R |
| 4,137,662 | 2/1979 | Baumer | 40/612 |
| 4,718,624 | 1/1988 | Greulich | 248/158 |
| 4,951,407 | 8/1990 | Werner | 40/608 |
| 5,318,258 | 6/1994 | Lang | 248/166 |
| 5,488,792 | 2/1996 | Kwoc | 40/612 |
| 5,520,141 | 5/1996 | Lutz | 116/173 |

*Primary Examiner*—Thomas Mullen
*Assistant Examiner*—Ashok Mannava
*Attorney, Agent, or Firm*—Middleton & Reutlinger; Charles G. Lamb

[57] ABSTRACT

A self-erecting control device is provided with a base member and a bracket assembly attached to the base member for receiving a movable sign support member. The movable sign support member is vertically movable and rotatable with the bracket. That is, in one position the sign support member is stationary in an upright position and in a second position, the movable sign support member is rotatable into a storage position. A flexing device, such as a spring, is mounted to the movable sign support member and a sign wherein upon impact the sign device yields in response to the impact and the coil spring returns or self-erects the sign to its original upright position.

7 Claims, 4 Drawing Sheets

SELF-ERECTING TRAFFIC CONTROL DEVICE

BACKGROUND OF THE INVENTION

This invention relates to self-erecting signs, particularly for use as highway safety or highway lane diverting signs. In one aspect, this invention relates to a self-erecting traffic control device which is yieldable in response to being struck by a motor vehicle. In another aspect, the invention relates to a self-erecting traffic sign and stand which are compact and require very little storage space for a plurality of signs and stands.

Highway safety signs are well known to convey information to motorists and the like to warn of construction along highways as well as providing for other highway information. Moreover, there are a number of traffic control devices or barriers which are utilized along areas of highway construction which divert the flow of traffic from, for example, a two lane highway to one lane along the areas of the highway construction. The most commonly used traffic control devices for diverting traffic from one lane to another along areas of highway construction are brightly colored drums and conically shaped plastic device which are light in weight with separate counterweights to hold the drums or plastic devices in place, such as sand bags, tire casings, or ring-shaped counter weights placed onto the drums or cones. These devices are yieldable upon contact by a motor vehicle without damage to the motor vehicle or injury to the persons in the motor vehicle. However, conical shaped plastic traffic control barriers or drum-shaped devices are easily fractured upon impact by a motor vehicle and therefore have a relatively short life span. Moreover, since these control devices are in two or three piece units, they require considerable time and labor to place and retrieve.

SUMMARY OF THE INVENTION

The present invention advantageously provides a straight forward arrangement of a portable, yieldable sign, particularly for use as a traffic control device. The present invention further provides a traffic control device which is yieldable and self-erecting upon impact by a motor vehicle. The present invention even further provides a traffic control device which is easily stored and requires a relatively small area for storage. Furthermore, the present invention provides a self-erecting, yieldable traffic control device particularly useful along highway construction routes to divert the flow of traffic from one lane to another. And, even further, the present invention provides for a traffic control device that is quickly and easily placed, retrieved and stored.

More particularly, the present invention provides a portable, yieldable sign device comprising: a base member, a bracket for rotatably receiving a sign support member wherein the bracket is mounted onto the base member, and, a sign yieldably attached to the sign support member.

BRIEF DESCRIPTION OF THE DRAWINGS

The invention is illustrated by the accompanying drawings in which corresponding parts in the drawings and the specification are identified by the same numerals and in which.

DESCRIPTION OF THE PREFERRED EMBODIMENT

Figure 1:
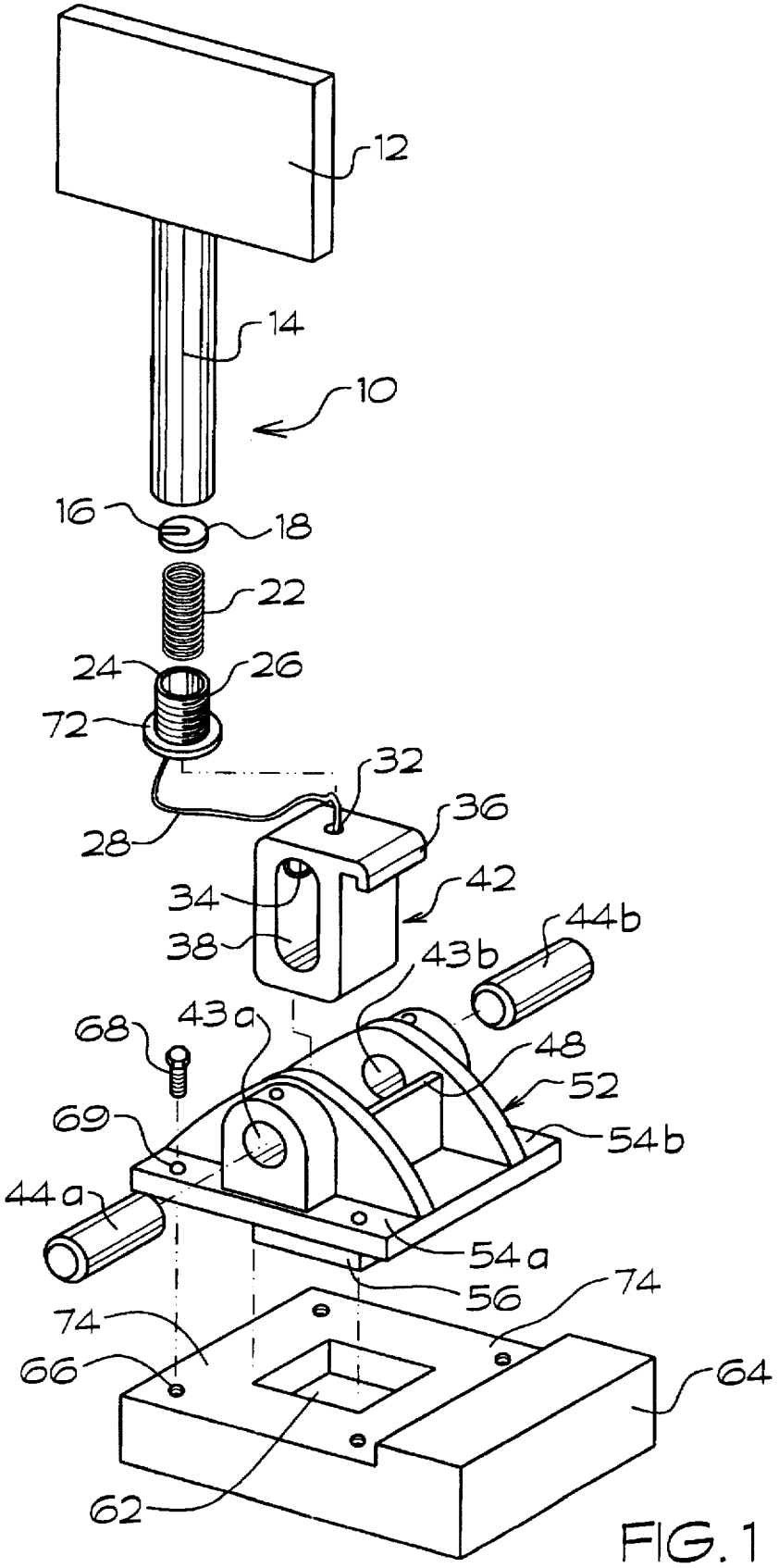
FIG. 1 is an exploded view of a traffic control device of the present invention.

In FIG. 1 is shown a portable, yieldable sign device 10 of the present invention. The portable, yieldable sign device 10 includes a stand or weighted base member 64 having a cut-out portion 74 therein to receive a bracket 52. Base member 64 is also provided with an opening 62 which is of the same configuration as the outer periphery of a collar 56 of bracket 52, the collar 56 being received within the opening 52. A plurality of apertures 66 having female threaded portions therein receive threaded male bolts 68 which extend through aligned openings 69 in the bracket 52 and base member 64 for attaching bracket 52 to base member 64.

Figure 2:
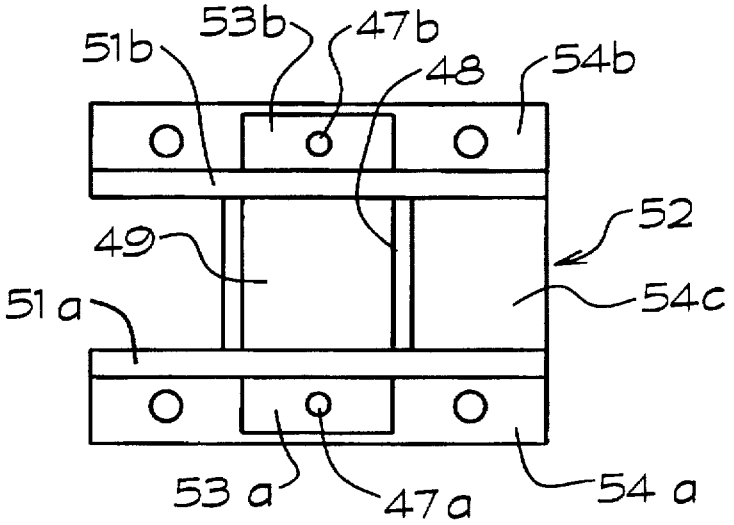
FIG. 2 is a top view of one component of the present invention.
Figure 3:
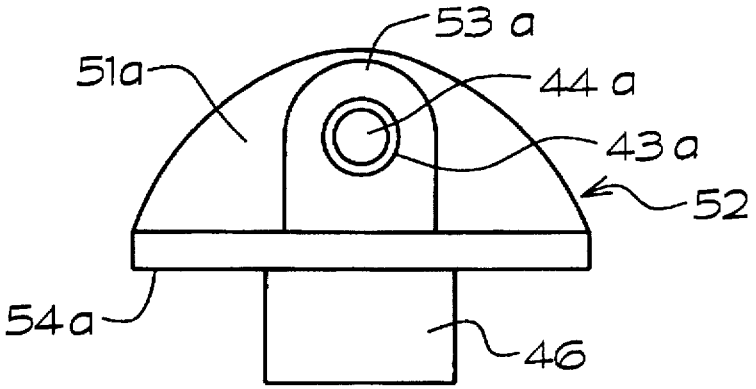
FIG. 3 is an elevational view of the component of FIG. 2.
Figure 4:
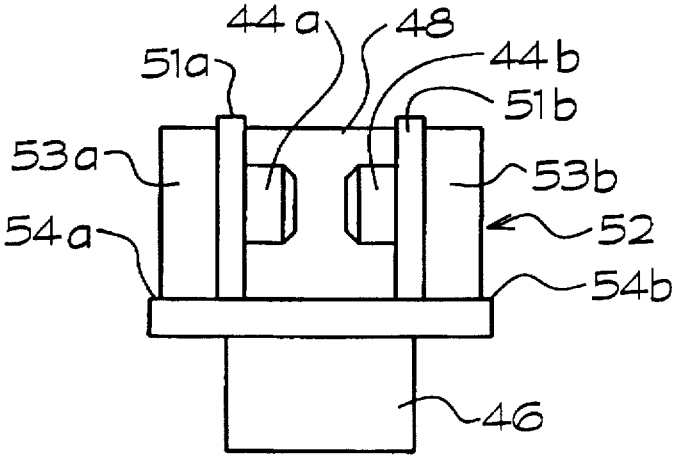
FIG. 4 is an end view of the component of FIG. 2.
Figure 5:
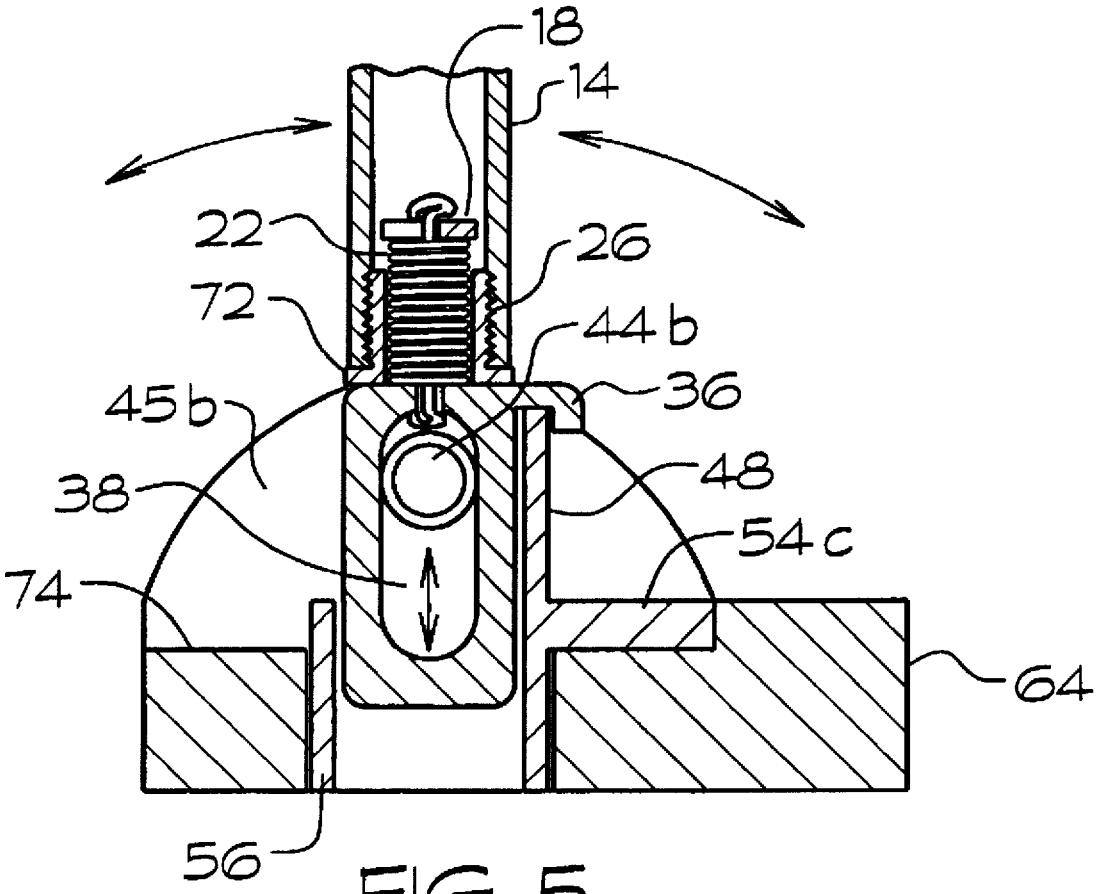
FIG. 5 is a partial sectional view of the device of FIG. 1.

As best shown in FIGS. 2, 3 and 4, the bracket 52 is provided with flanged portions **54*a*, 54*b*, 54*c* which rest upon the cut-out portion 74 (FIGS. 1 and 5). The bracket 52 is also provided with vertically extending support sections 51*a*, 51*b* with reinforcing flanged portions 53*a*, 53*b*, having openings 43*a*, 43*b* extending therethrough, respectively, for receiving the sign support member mounting pivot pins shown as sleeves 44*a*, 44*b* (FIGS. 1 and 5). The flanged portions 53*a*, 53*b* are provided with threaded openings in the top thereof which extend through top openings 43*a*, 43*b* to receive threaded male members 47*a*, 47*b* therein for holding the pins 44*a* and 44*b* secure within the flanged portions 53*a*, 53*b* and vertically extending support sections 51*a*, 51*b*. A vertically extending finger engaging member 48 is also provided for cooperating relationship with a finger 36 (FIGS. 1 and 5) of sign support member 42 for maintaining sign support member 43 in an upright position when base member 64** is placed on a surface, such as a highway.

Referring back to FIG. 1, the sign support member 42 is provided with an elongated slot 38 in which the pivot pins **44*a*, 44*b* extend a selected distance therein. With the pins 44*a*, 44*b* in place, the movable sign support member 42 is movably received within the bracket 52. In its downward most position, the movable sign support member 42 fits within an opening 49 (FIG. 2) of the collar 56 of the bracket 52 with the finger 36 mating with the finger engaging member 48 as best shown in FIG. 5 and when base member 64 is moved upwards away from a surface, finger 36 is disengaged from finger engaging member 48 and pivots about pins 44*a*, 44*b* as shown in FIG. 7**.

The movable sign support member 42 is provided with a channel 34 in the upper most portion of the elongated slot 38 to receive one end of a flexible member, such as wire 28, which extends upward through opening 32 in the sign support member 42 (FIGS. 1 and 5). The wire 28 also extends up through a through-bore 28 in plug 72. Also disposed within through-bore 28 is a coil spring 22 encircling wire 28. A cap 18 having a slot 16 therein is provided to receive a second end of the wire 28. Cap 18 has a diameter greater than the coil spring 22 and therefore maintains the wire within the coil spring 22. As best shown in FIG. 5, a tubular post 14 onto which sign 12 is mounted is provided with an elongated opening to receive the spring 22 therein. And, post 24 is provided with female threads to receive the male threaded portion 26 of the plug 72.

Figure 6:
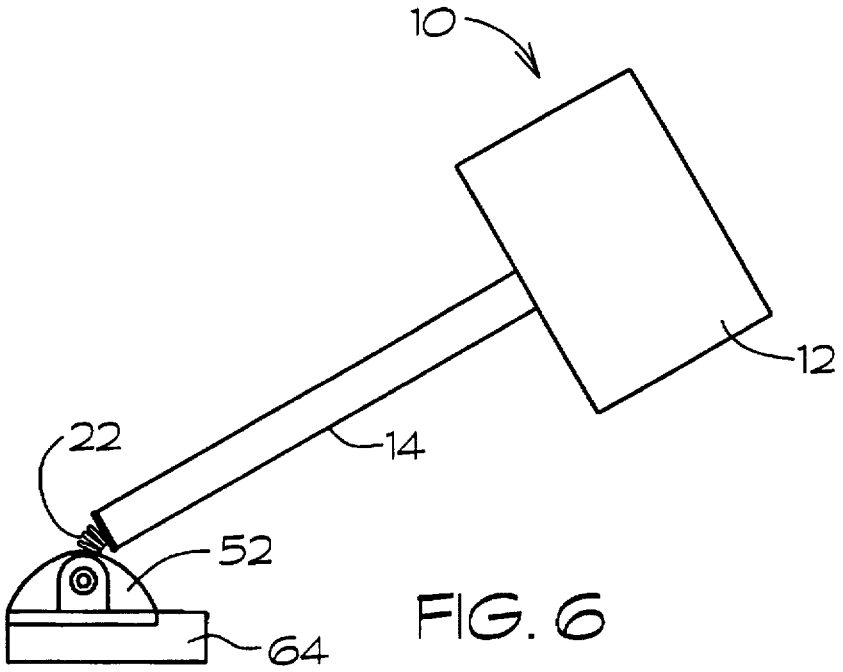
FIG. 6 is an elevational view of the device of the present invention shown in a yielding position; and, FIG. 7 is an elevational view of a plurality of devices of the present invention shown stacked in storage.

In operation, as shown in FIG. 6, when the weighted base member 64 is placed on a surface, by gravity, the movable sign support member 42 is received within the collar 56 and finger 36 is in engagement with the finger engaging member 48 of bracket 52. Upon impact by a motor vehicle, or the like, the sign 12 and post 14 yield to the sign as the spring 22 bends in response to the impact. As soon as the impact is complete the coil spring 22 self-erects the sign 12 and post 14 to their original vertical or upright position.

Figure 7:
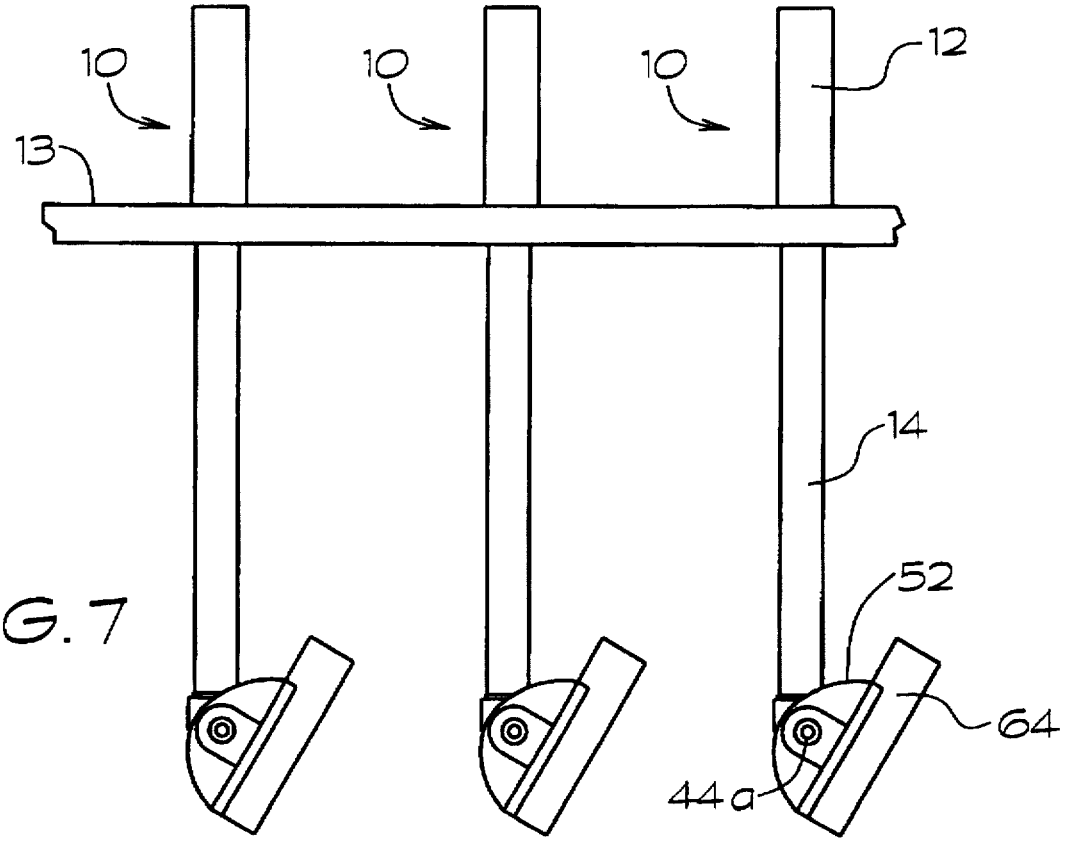

As shown in FIG. 7, the portable, yieldable sign of the present invention requires very little room for storage and as shown, a plurality of sign devices 10 are stacked on a pair of horizontal rod members 13, only one being shown, wherein the horizontally extending rod members 13 are parallel and spaced apart a sufficient distance to receive the signs 12 thereon with the posts 14 extending downwardly therebeneath. As the portable, yieldable sign device 10 is picked up or removed from its location on or along a highway, the weight of the base member 64 and the bracket 52, which are attached to the movable sign support member 42 by pins **44*a*, 44*b* being disposed within the elongated slot 38, provide the means for the movable sign support member 42 to be pulled away from the collar 56 by a distance equal to the length of the elongated slot 38. With the movable sign support member 42 moving out of the collar 56 of the bracket 52, the finger 36 is no longer engaged with the finger engaging member 48 of bracket 52 and with the center of gravity of the bracket 52 being off-center of the base member 64, the bracket 52 and base member 64 pivot around sleeves 44*a* and 44*b*, as shown in FIG. 7, thereby enabling very little space to stack and store a plurality of the portable, yieldable signs devices 10**.

It is to be understood that the description and examples of the present invention given hereinafter are not by way of limitation and various modifications within the scope of the present invention will occur to those skilled in the art upon reading the disclosure set forth hereinafter.

What is claimed is:

1. A self-erecting traffic control device sign comprising:

a weighted base member;

a bracket mounted onto said base member, said bracket having a center of gravity off-center of the base member;

a movable sign support member pivotally attached to said bracket whereby when said member is moved from a horizontal support surface said base member and said bracket pivot to a vertical position; and, a vertically extending sign including yielding means attached to said movable sign support member whereby said sign yields upon impact and self-erects to its original vertical position when said impact is complete.

2. The device of claim 1, said base member having an opening therein and said bracket having a collar in mating relation with said opening.

3. The device of claim 2, said collar having a longitudinally extending through-bore, said through-bore receiving said movable sign support member therein.

4. The device of claim 3, said sign support member having an elongated opening therein and said bracket includes a pair of pivot pins disposed in aligned spaced relation within said elongated opening.

5. The device of claim 3, said sign support member and said bracket having cooperating means to lock said sign support member in an upright position.

6. The device of claim 5, said cooperating means comprising said sign support member having a finger and said bracket having a finger engaging member whereby when said finger and said finger engaging member are in an engaging relation, said sign support member is in an upright position.

7. The device of claim 1, said sign including yielding means attached to said movable sign support member including a tubular post having said sign mounted on one end and a longitudinally extending opening in an opposed end, and a spring received within said longitudinally extending opening, said opening being attached to receive said sign support member.

* * * * *